United States Patent [19]

Engler et al.

[11] 4,381,839

[45] May 3, 1983

[54] GANTRY HAVING ADJUSTABLE SIDE SUPPORTS

[75] Inventors: Edgar D. Engler, Willow Springs; Gary V. Lorenz, Moline, both of Ill.

[73] Assignee: Riggers Manufacturing Co., Bettendorf, Iowa

[21] Appl. No.: 239,318

[22] Filed: Mar. 2, 1981

[51] Int. Cl.[3] ..... B66C 11/00

[52] U.S. Cl. ..... 212/208; 238/21

[58] Field of Search ..... 212/208, 209, 220, 210; 104/107, 106, 94; 238/21

[56] References Cited

U.S. PATENT DOCUMENTS

| | | | |
|---|---|---|---|
| 2,599,599 | 6/1952 | Akens | 238/21 |
| 2,995,094 | 8/1961 | Wallace | 212/208 |
| 3,302,801 | 2/1967 | Povoli | 212/208 |
| 3,335,875 | 8/1967 | Fachinetti | 212/208 |
| 4,262,519 | 4/1981 | Mason | 72/705 |

FOREIGN PATENT DOCUMENTS

| | | | |
|---|---|---|---|
| 680982 | 8/1979 | U.S.S.R. | 212/208 |
| 688419 | 10/1979 | U.S.S.R. | 212/208 |

*Primary Examiner*—John J. Love
*Assistant Examiner*—L. E. Williams

[57] ABSTRACT

A large gantry for straddling and handling a heavy load comprises a pair of vertical support assemblies which support a horizontal load-bearing gantry beam. Each support assembly comprises three vertically disposed independently extendable/retractable hydraulic rams. A tiltable self-leveling sole plate is located between the upper ends of the three rams in each support assembly and the underside of an end of the gantry beam. A control system which includes selectively operable panel-mounted joy-stick actuated control switches and control valves effects operation of the rams in unison to raise and lower the gantry beam and also effects independent individual operation of any ram to level the beam if necessary. The arrangement increases the stability, the load-handling capacity and the operational safety of the gantry.

6 Claims, 10 Drawing Figures

GANTRY HAVING ADJUSTABLE SIDE SUPPORTS

BACKGROUND OF THE INVENTION

1. Field of Use

This invention relates generally to gantries for spaning loads which are to be raised and lowered. In particular, the invention relates to gantries which comprise spaced-apart vertically adjustable side support assemblies having horizontal load-bearing gantry beam supported therebetween.

2. Description of the Prior Art

Large gantries of the aforesaid character are sometimes employed instead of boom-type cranes to emplace or remove large heavy loads on trucks, trailers and rail-road flat cars. Such gantries for handling loads weighing hundreds of tons may be on the order of 25 feet wide and 25 feet high and, because of their size and weight, are assembled on the job site. In some gantries the side support assemblies take the form of stationary structures, such as A-frames, and hoists are mounted on the gantry beam to raise and lower the load. However, in some other gantries the side support assemblies themselves can be raised and lowered vertically, as by means of a single vertically disposed extendable/retractable hydraulic ram, to raise and lower the load-bearing gantry beam and any load thereon. In gantries employing such hydraulic rams, a control system is provided to enable the gantry operator to extend and retract the rams in unison. A principal difficulty with such prior art hydraulic ram systems is that extreme ram extension to raise the beam and load thereon causes the entire gantry to become unstable and the effect is further aggravated as the loads become heavier. In extreme cases it is possible for the gantry to tip over thereby risking or causing damage to the gantry, the load and near-by equipment and injury to near-by personnel. It is necessary, therefore, to limit the weight of the load being handled, or to limit the height to which the side supports are raised, or to provide a larger gantry. These considerations and solutions are time-consuming and costly.

SUMMARY OF THE INVENTION

In accordance with the present invention there is provided an improved large modular gantry for straddling a large heavy load and for raising, supporting and lowering the same. The gantry, which is to be transported to and assembled on the job site as by stacking together of components, comprises a pair of laterally spaced-apart vertically disposed support assemblies and a horizontally disposed loadbearing gantry beam extending between and supported by the support assemblies. The beam is, for example, about 25 feet long and can be moved, for example, to any position between about 8 to 24 feet above the ground. The beam carries one or more lifting link assemblies from which a load can be suspended. Each support assembly comprises a plurality of (three) vertically disposed independently extendable/retractable hydraulic rams. A tiltable self-leveling or self-adjusting sole plate is located between the upper ends of the plurality of rams in each support assembly and the underside of an end of the gantry beam. The sole plate has ball-and-socket type universal joints connected between the ram ends. A control system which includes selectively operable panel-mounted joy-stick actuated control switches and hydraulic control valves effects operation of the rams in unison to raise and lower the gantry beam and also effects independent individual operation of any ram to level the beam, if necessary. The arrangement increases the stability, the load-handling capacity and the operational safety of the gantry.

A gantry in accordance with the present invention offers several advantages over the prior art. For example, use of a plurality of individually or independently controllable extendable/retracable elements, such as hydraulic rams, in the side support assemblies and use of a tiltable self-adjusting sole plate with each ram at each end of the load-bearing gantry beam enables the beam (and each end thereof) to be accurately adjusted and leveled prior to raising of a load. This ability substantially improves the stability of the gantry under load, thereby increasing the size and weight of the load which can be safely handled and increases the height to which it can be safely raised. The improved control system which uses a single joy-stick control for the several rams in one side support assembly for raising and lowering the gantry beam and for operating and adjusting the gantry beam to level it is reliable and easily and quickly manipulated by the operator to effect adjustments, thereby further adding to safety in use of the gantry. Furthermore, the modular nature of the components comprising the side support assemblies and the beam of the gantry to and from the job-site and also facilitates assembly and disassembly of the gantry at a job site by means of a fork-lift truck, for example. Other objects and advantages will hereinafter appear.

DRAWINGS

DESCRIPTION OF A PREFERRED EMBODIMENT

Figure 1:
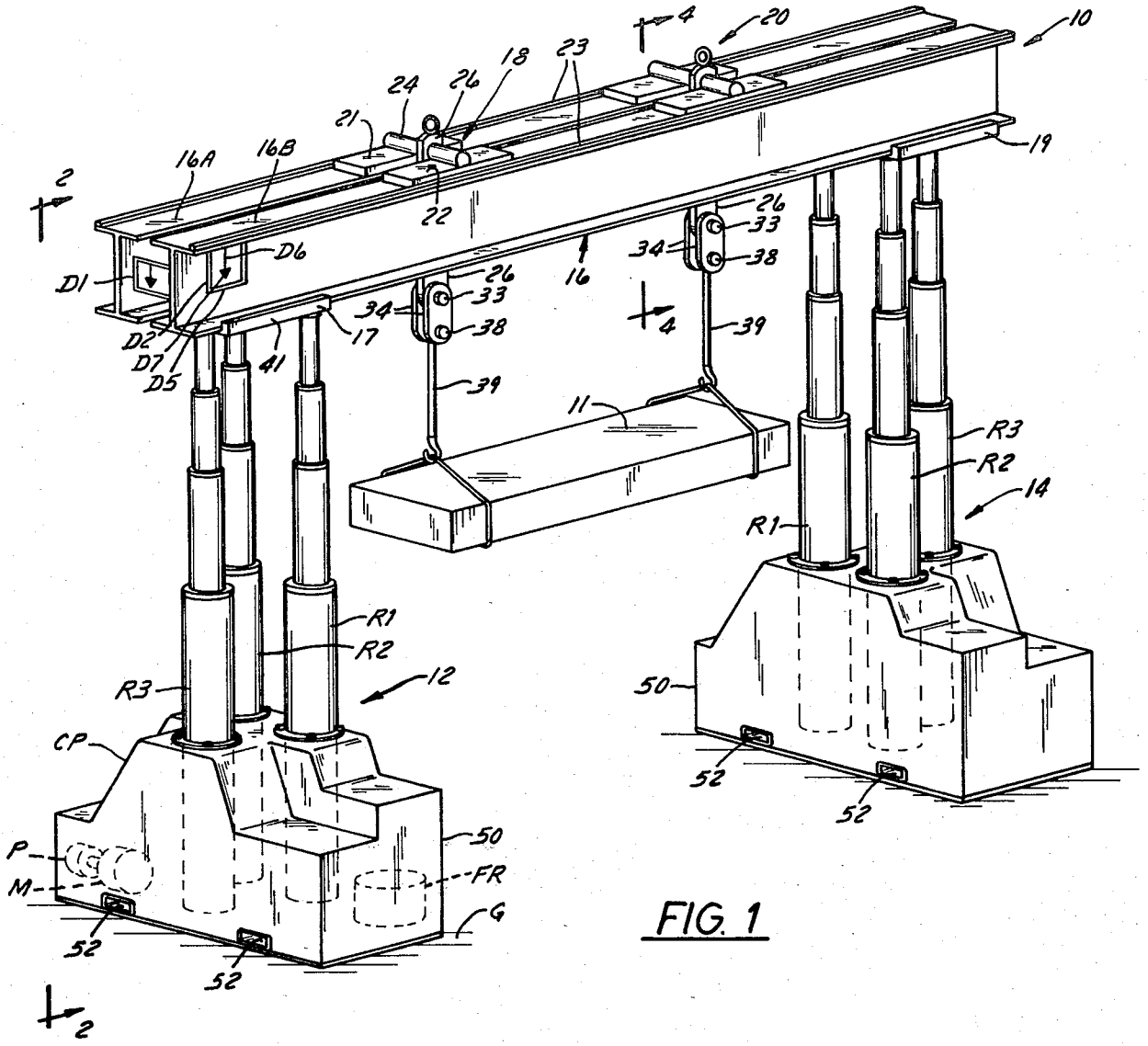
FIG. 1 is a perspective view of a gantry in accordance with the present invention.
Figure 3:
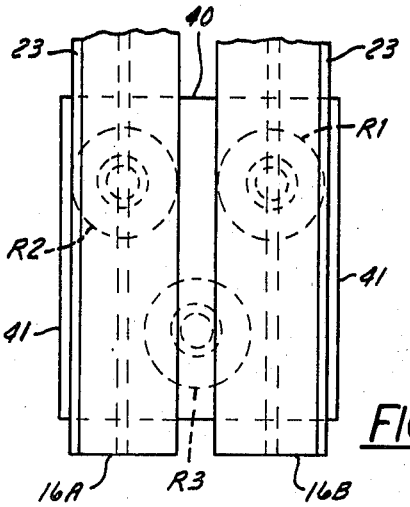
FIG. 3 is a top plan view of the support assembly and associated gantry beam end shown in FIG. 2.
Figures 7, 8:
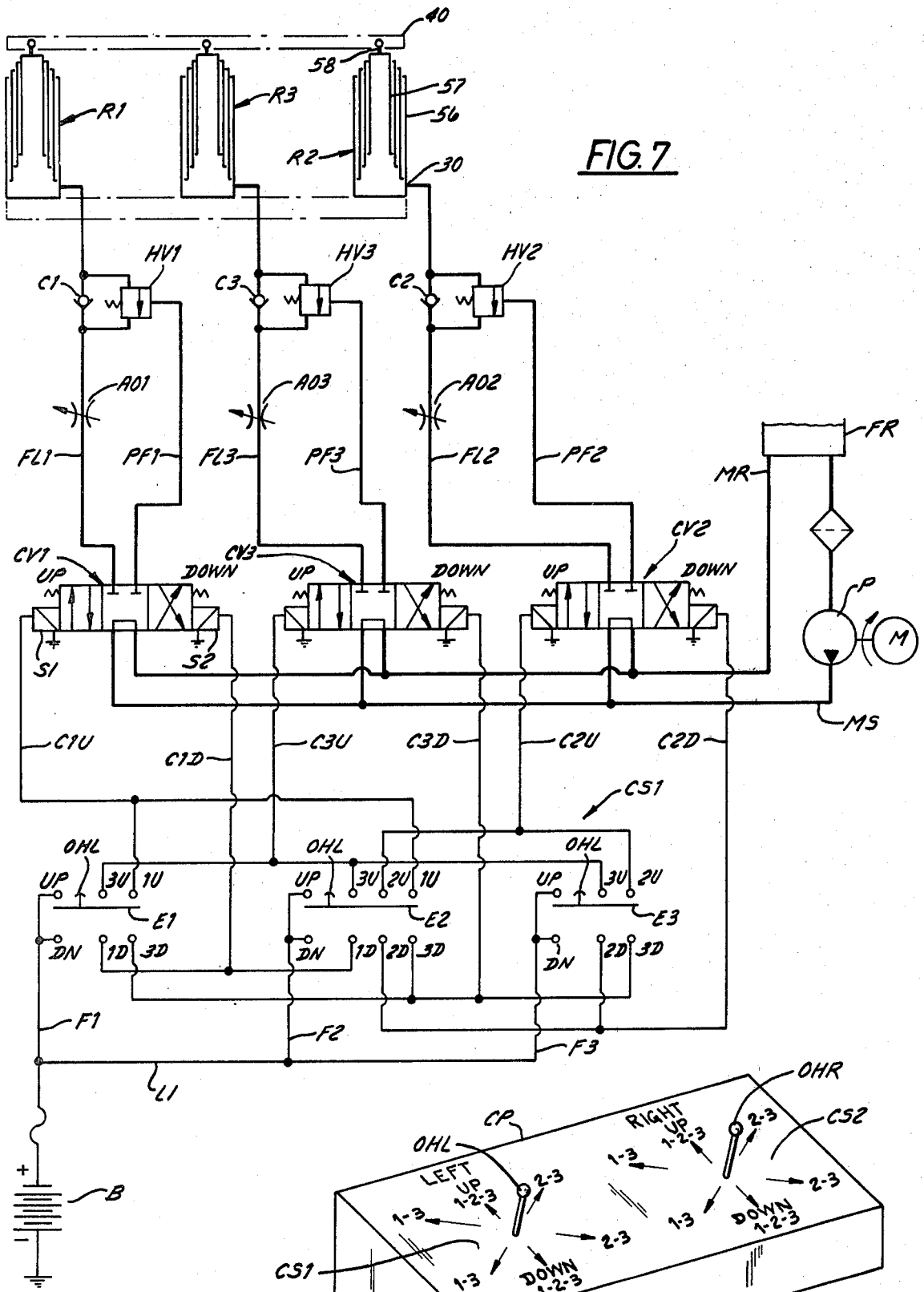
FIG. 7 is a schematic diagram of the electro-hydraulic control system for the rams in one support assembly of the gantry.
FIG. 8 is a perspective view of the operator's control panel incorporating two joy-stick control switches, one of which is shown schematically in FIG. 7.
Figure 9:
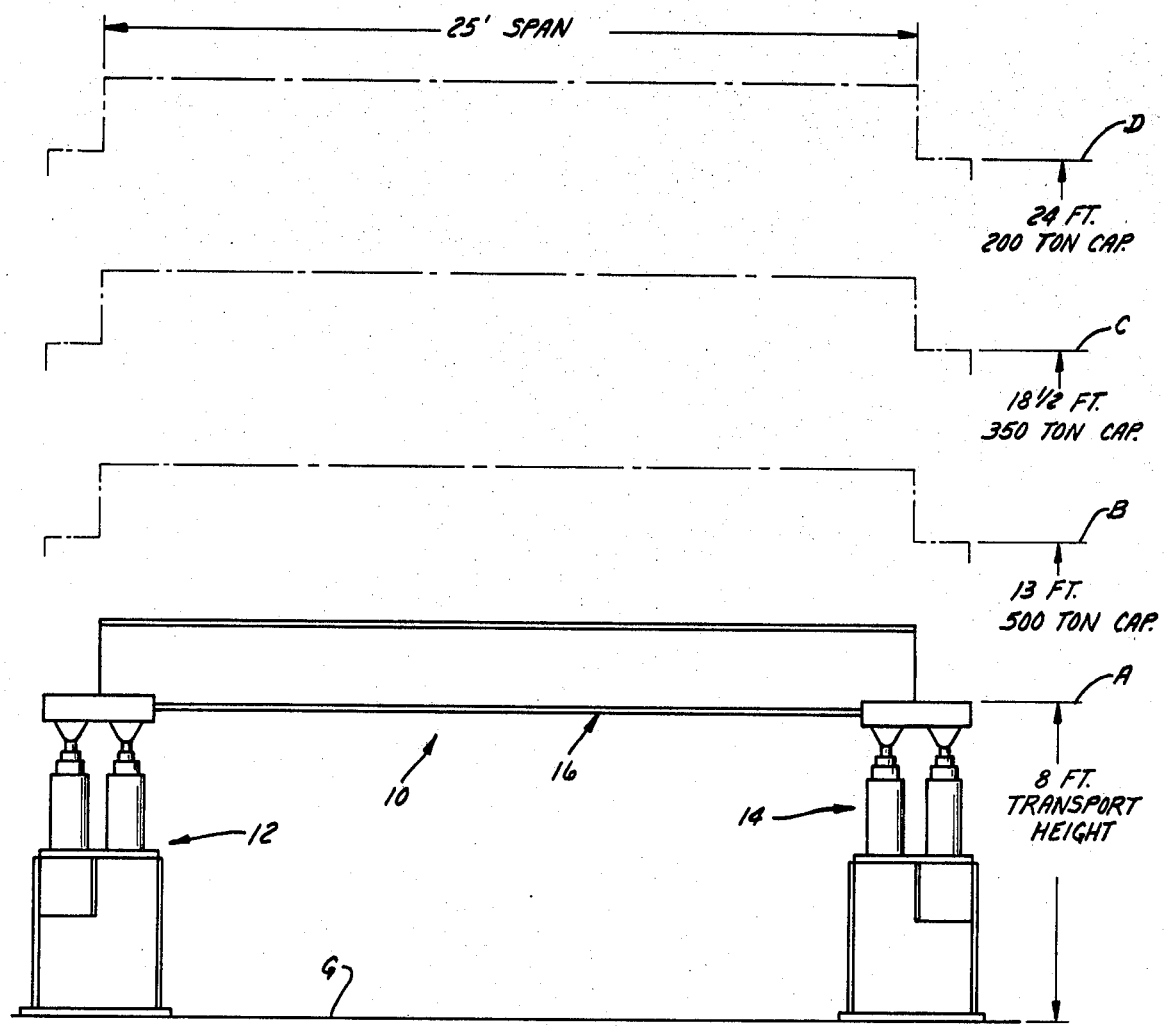
FIG. 9 is a front elevational view of the gantry of FIG. 1 showing it in solid lines in fully lowered position and indicating by broken lines some alternate raised positions.
Figure 10:
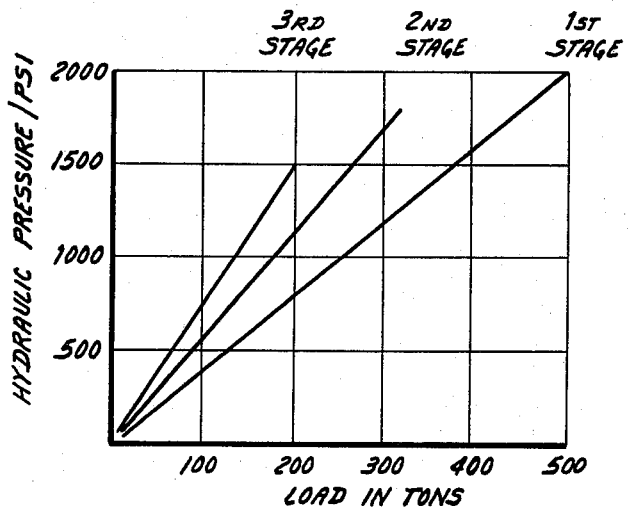
FIG. 10 is a load chart for the gantry.

FIG. 1 is a perspective view of a large gantry or gantry type crane 10 in accordance with the present invention. Gantry 10 is understood to be adapted to lift, support and lower large loads 11 on the order of up to 500 tons, for example. As FIGS. 1 and 9 show, gantry 10 comprises a pair of laterally spaced apart support assemblies 12 and 14, each having rams R1, R2, R3 which can be raised and lowered; a load-bearing gantry beam 16 extending between and supported on tilitable sole plate assemblies 17 and 19 located at the upper ends of the support assemblies 12 and 14, respectively; and a pair of lifting link assemblies 18 and 20 mounted on beam 16 from which load 11 is suspended by cables 39. Each support assembly 12, 14 comprises the three hydraulic rams R1, R2, R3 which are disposed in triangular relationship as shown in FIG. 3. FIG. 9 shows that beam 16 is on the order of 24 feet long and can be raised and lowered between a lowermost position about 8 feet above ground G and an uppermost position about 24 feet above the ground and to any position therebetween. FIGS. 1, 7 and 8 depict portions of control means, hereinafter described, for raising and lowering rams R1, R2, R3 in the support assemblies 12 and 14 in unison or individually.

As will be understood, gantry 10 is adapted to be transported, as by truck or rail-road car, to a job site whereat its basic modular components, namely, support assemblies 12 and 14 and beam 16, are assembled in such a position as to straddle the load 11 which is to be handled. After use, gantry 10 is disassembled for transport elsewhere.

As FIGS. 1, 2, 3 and 4 show, gantry beam 16 comprises two steel I-beams 16A and 16B which are disposed in side-by-side spaced apart relationship and mechanically secured together temporarily during use by the two load lifting link assemblies 18 and 20 and by the tiltable sole plate assemblies 17 and 19.

Figure 4:
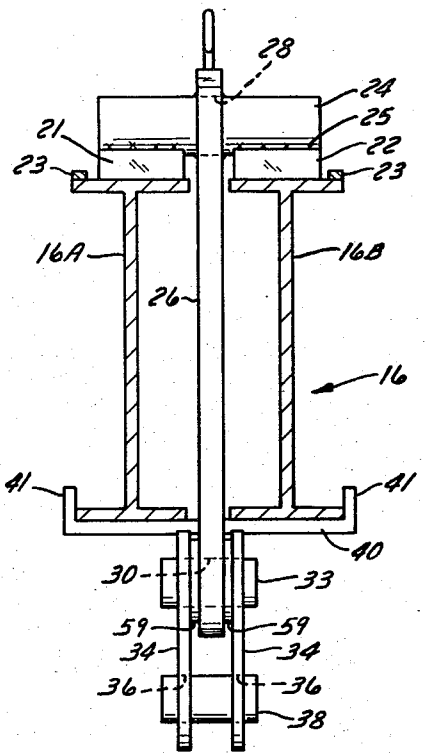
FIG. 4 is a cross-sectional view of the gantry beam and a lifting link thereon taken on line 4—4 of FIG. 1.

More specifically, load lifting link assembly 18, which is understood to be substantially identical to link assembly 20, comprises a pair of spaced apart flat steel plates 21 and 22 which are secured in fixed relationship to each other by means of a large round steel bar or upper pin 24 which is welded to the plates as at 25 as shown in FIG. 4. The plates 21 and 22 maintained in proper position on the I-beams by guide rails 23 (shown in FIGS. 1 and 4) on the tops of the I-beams 16A and 16B. Pin 24 pivotally supports a vertically depending steel plate or upper link member 26 which has an upper hole 28 therein near its upper end for accomodating the pin 24. Member 26 is provided near its lower end with a lower hole 30 for accomodating a lower pin 33 on which a pair of lower link members 34 are pivotally supported. The lower link members 34 have holes 36 for accomodating another pin 38 to or a round which cables, such as 39, for example, may be attached as shown in FIG. 1. Spacer plates 59, shown in FIG. 4 are provided on pin 33, each being located between a link member 34 and upper link 26. Each link assembly 18, 20 can be positioned at a desired location on beam 16 to suit the load 11 being handled.

Figure 5:
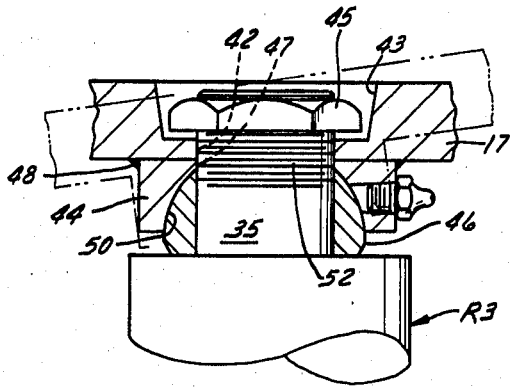
FIG. 5 is an enlarged view, partly in cross-section, taken on line 5—5 of FIG. 2 and showing the top end of the hydraulic rams in the support assembly and its associated tiltable sole plate.
Figure 2:
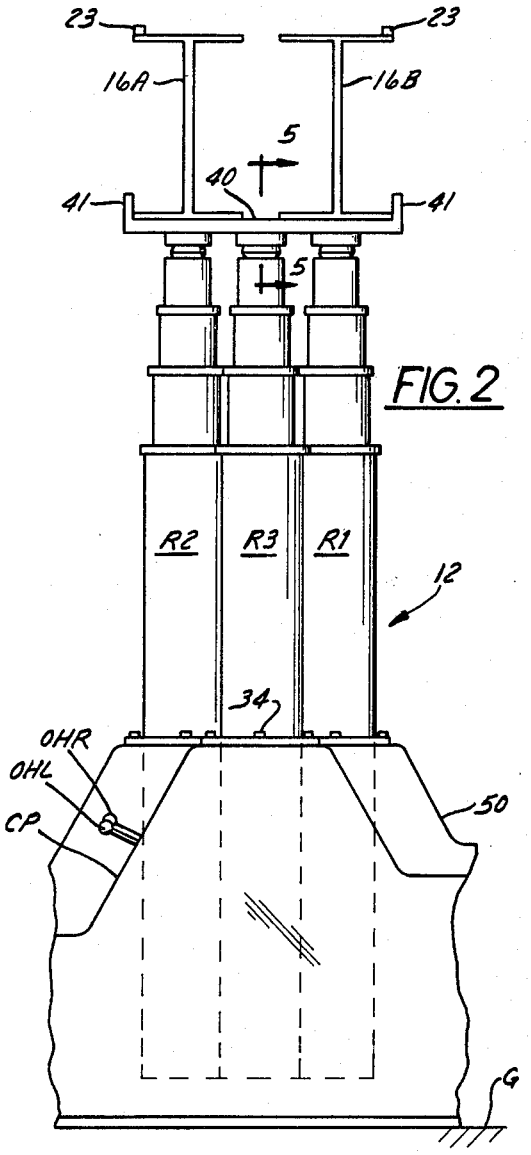
FIG. 2 is a side elevational view of that side support assembly shown on the left side of FIG. 1 and taken on line 2—2 of FIG. 1.
Figure 6:
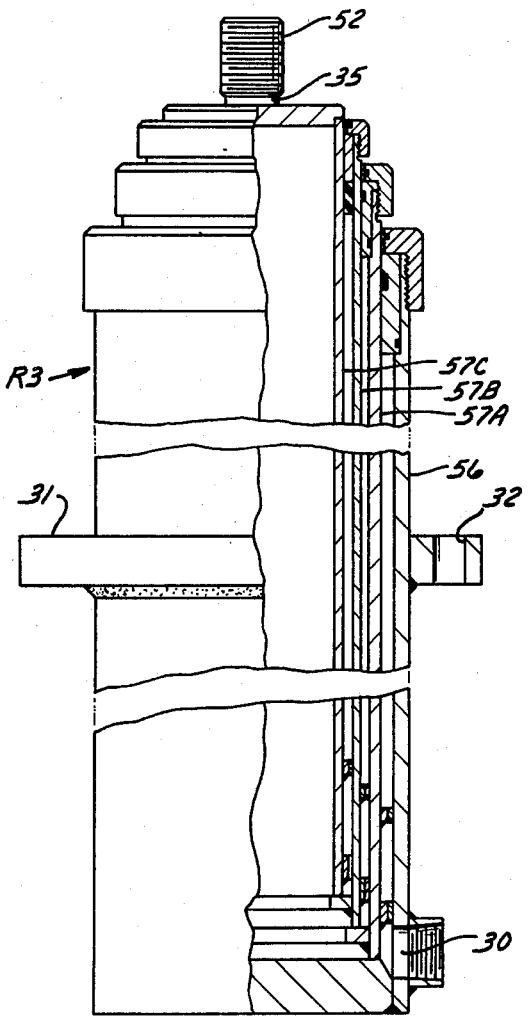
FIG. 6 is a cross-sectional view of the hydraulic ram of FIG. 5.

The tiltable sole plate assembly 17, which is understood to be substantially identical to sole plate assembly 18, comprises a flat steel plate 40 which has upwardly projecting side flanges 41 between which the bottom portions of the I-beams 16A and 16B are situated. The flanges 41 prevent the beams 16A and 16B from shifting away from each other and off the plates 40. As FIGS. 2, 3 and 5 show, plate 40 is provided with universal joints on its underside by means of which it is connected to the top or rod ends of the rams R1, R2, R3. Thus, plate 40 is provided with three holes 42 extending therethrough and is also provided on its underside with a plurality of socket members 44, one for each hole 42. As FIG. 5 shows, each hole 42 is recessed as at 43, in the top of plate 40, to receive a nut 45 hereinafter described. Each socket member 44, which is part of a universal joint further comprising a ball member 46, has a hole 47 which registers with a hole 42 in plate 40 and is welded as at 48 to the underside of plate 40. Each socket member 44 also comprises a hemispherical recess 50 for slidably accomodating a ball member 46. As FIGS. 5 and 6 make clear, each hole 42 in plate 40 and the registering hole 47 in its associated ball member 46 accomodates the threaded end 52 of a piston rod 35, hereinafter described. Threaded end 52 engages nut 45 and is disposed in recess 43 to secure the plate 40 and its associated three ball-and-socket type universal joints to the top ends of the three rams R1, R2, R3.

As FIGS. 2, 3 and 5 make clear, if rams R1, R2, R3 are extended an equal distance above the ground G, the sole plate assembly 17 would be perfectly level or horizontal and would support one end of gantry beam 16 in level position. However, if the nature of load 11 were such as to cause beam 16 to be out of level or twisted because of forces exerted by a load during handling thereof, extension/retraction of the appropriate rams R1, R2, R3 would effect desired planar repositioning of plate 40 of sole plate assembly 17 and the ball-and-socket type universal joints would enable such repositioning of plate 40. Beam 16 is provided with visual indicating devices, such as D1 and D2 shown in FIG. 1 which enable the operator to determine if the gantry is balanced and level when set up or where subjected to load. Each device D1, D2 comprises a reference frame D5 and a levelling line D6 having a plumb bob D7 thereon.

FIGS. 1 and 9 show both support assemblies 12 and 14 and FIGS. 2, 3 and 7 show only assembly 12. Since support assemblies 12 and 14 are substantially identical to each other, only assembly 12 will hereinafter be described in detail. Assembly 12 comprises a stationary base portion 50, fabricated of heavy steel plate, and furnishing mechanical support for the three vertically disposed hydraulic rams R1, R2, R3 which are mounted thereon. Base portion 50 also houses or supports some control system components such as an electric motor M, a hydraulic pump P, a control panel CP (see FIG. 8), and a hydraulic fluid tank or reservoir FR. Portions of the control system for the rams of assembly 12 are shown in FIG. 7. Base portion 50 is also provided with access holes 52 for receiving the tines (not shown) of a fork-lift truck (not shown) used to assemble and disassemble the gantry 10 at a job-site.

Since the hydraulic rams R1, R2, R3 in the assemblies 12 and 13 are substantially identical to each other, only ram R3 shown in FIGS. 1, 2, 3, 5, 6, 7 and 9 is hereinafter described in detail. Ram R3 is a commercially available three-stage single action telescopic ram comprising a stationary cylinder 56 having three telescopic rods or tubes 57A, 57B, 57C therein (designated in FIG. 7 as a piston 57 to which outwardly and upwardly extending piston rod 58 is connected. Cylinder 56 is provided with a rigidly secured flange 31 thereon which is provided with bolt holes 32 for accomodating bolts 34 which rigidly secure cylinder 56 on base portion 50 of assembly 12 in vertical or upright position. Cylinder 56 is provided near its bottom end with a fluid port 30 through which fluid is admitted to and expelled from ram R3 during extension and retraction of piston rods 57A, 57B, 57C. The bottom end of each rod 57A, 57B, 57C is open to accomodate fluid flow to and from cylinder port 30.

FIG. 7 shows that portion of the electro-hydraulic control system which operates to control the rams R1, R2, R3 in support assembly 12. It is to be understood that assembly 14 is provided with substantially similar control components. The control system generally comprises the fluid reservoir FR for supplying hydraulic fluid to the pump P which is driven by electric motor M. Pump P is connected by a main fluid supply line MS to three solenoid-operated three-position control valves designated CV1, CV2, CV3. These valves are connected to reservoir FR by a main fluid return line MR.

The control valves CV1, CV2, CV3 are connected to control fluid flow to and from the rams R1, R2, R3, respectively. Each control valve CV1, CV2, CV3 is conventional and has an up, down and neutral position, and a pair of alternately energizable solenoids S1 and S2. Energizing of a solenoid S1 and S2 effects up or down positioning, respectively, of its associated valve. More specifically, when each valve CV1, CV2, CV3 is in neutral position, fluid in line MS from pump P is returned through line MR to reservoir FR. The control valves CV1, CV2, CV3 all operate in a similar manner. Therefore, only operation of valve CV1 and its associated components is hereinafter described in detail. Thus, when a control valve, such as CV1 for example, is placed in up position by energization of its solenoid S1, it enables fluid flow from line MS, through fluid line FL1, through an adjustable orifice A01, and through a ball-type check valve C1 to the inlet port 30 of ram R1 to effect upward extension of ram R1. Return of valve CV1 to neutral stops such upward extension of ram R1 and check valve C1 closes under fluid pressure in ram R1 to hold ram R1 in its raised position. A pilot pressure responsive holding valve HV1 in parallel with check valve C1 is maintained closed (as shown in FIG. 7) or in up position. When control valve CV1 is placed in down position by energization of its solenoid S2, it supplies fluid from line MS through a pilot fluid line PF1 to holding valve HV1 causing the latter to open and allow fluid to drain from ram R1, through valve HV1, through line FL1, through control valve CV1, through return line MR to reservoir FR. This allows ram R1 to retract under force of gravity.

As FIGS. 7 and 8 show, the control valves CV1, CV2, CV3 for the rams R1, R2, R3, respectively, of side support assembly 12 are operated in response to action of a joy-stick type electrical control switch CS1 which is mounted on control panel CP on the base 50 of side support assembly 12. Panel CP could, of course, be mounted elsewhere on the gantry 10, or even remote therefrom. As will be understood, since switch CS1 for assembly 12 and switch CS2 for assembly 14 are similar, only CS1 is hereinafter described in detail. As FIG. 7 shows, switch CS1 is adapted to effect selective energization of the up solenoids S1 and the down solenoids S2 of the control valves CV1, CV2, CV3 from a battery B which has one side ground (as is one side of each solenoid S1, S2). The other side of battery B is connected by a bus line L1 and three supply lines F1, F2, F3, each of which terminates at a pair of supply contacts designated UP and DN in switch CS1. Switch CS1 comprises a joy-stick tyoe operating handle OHL which is movable from neutral position shown in FIGS. 7 and 8, to any one of six operating positions wherein the following control functions listed in Table 1 effecting extension/-retraction of the rams would occur with respect to rams R1, R2, R3 in support assembly 12, namely:

TABLE I (1) Rams R1 and R3 extend
(2) Rams R1, R2, R3 extend
(3) Rams R2 and R3 extend
(4) Rams R1 and R3 retract
(5) Rams R1, R2, R3 retract
(6) Rams R2 and R3 retract As is apparent from the above list considered in conjunction with FIGS. 7 and 8, the beam 16 is raised by simultaneously moving the handles OHL and OHR of switches CS1 and CS2, respectively, to position (2) above. Beam 16 is lowered by simultaneously moving handles OHL and OHR to position (5) above. Other coordinated or individual movements of the handles OHL and OHR effect adjusting movements of the various rams, the sole plates thereon, and the beam end associated therewith.

As FIG. 7 shows, operating handle OHL effects appropriate motion of the movable switch elements E1, E2, E3 so as to energize stationary contacts designated 1U, 2U, 3U, 1D, 2D, 3D from the UP, DN supply contacts. Each contact 1U, 2U, 3U, 1D, 2D, 3D is connected by an electrical conductor designated C1U, C2U, C3U, C1D, C2D, C3D, respectively to the appropriate solenoid S1, S2 of a control valve CV1, CV2, CV3.

OPERATION

Gantry 10 and the control system therefor operates as follows. Assume that gantry 10 is assembled as shown in FIGS. 1 and 9 and that beam 16 with load 11 thereof is to be raised from lowermost position A in FIG. 9 to some position B, C, D thereabove. Further assume motor M and pump P are in operation; that handles OHL and OHR of switches CS1 and CS2, respectively, are in neutral and that the rams R1, R2, R3 in each support assembly 12, 14 are at rest.

To raise beam 16 and its load 11, both handles OHL and OHR are moved simultaneously to position (2) in Table I, whereupon all control valves CV operate to simultaneously extend all rams R. If it is discovered from observation of the levelling devices D1, D2 that such initial movement causes beam 16 to tip or tilt under load, then the appropriate operating handle OHL, OHR is moved to the appropriate position to effect extension or retraction of those rams which will cause beam 16 to resume level position. As the rams move, the effect levelling of the plate 40 and the beam 16 thereon.

Beam 16 and load 11 are raised to the desired height by manipulation of the levers OHL and OHR, whereupon the truck (not shown) or flatcar (not shown) is moved from therebeneath. Thereafter, load 11 may be lowered, deposited on the ground or another transport vehicle (not shown) placed therebeneath.

As will be understood, levelling of the beam 16 is initially carried out as the gantry is being assembled and set up and before the beam is subjected to a load 11.

We claim:

1. A gantry for straddling a load and for raising, supporting and lowering the same comprising:

a pair of spaced apart support assemblies, each support assembly comprising a stationary base portion and three vertically disposed independently extendable/retractable hydraulic rams mounted on said base portion in triangular relationship to one another;

a pair of tiltable sole plates, each tiltable sole plate being mounted on the upper ends of the three rams of a support assembly;

means for connecting the upper end of each ram to its associated sole plate and including universal joint means and releasable attachment means;

a load-supporting gantry beam extending between said spaced apart support assemblies and comprising a pair of beams arranged in spaced apart side-by-side relationship supported on said pair of sole plates;

a load lifting link assembly mounted on said gantry beam and comprising link support means mounted on said pair of spaced apart beams and link means connected to said link support means and extending downwardly between said pair of spaced apart beams;

said spaced apart beams being maintained in spaced apart side-by-side relationship with each other by means of said sole plates and said lifting link assembly;

and selectively operable control means operatively connected to said hydraulic rams and operable to effect extension/retraction of all of said hydraulic rams in unison to raise and lower said gantry beam and to effect extension/retraction of individual or predetermined combinations of said hydraulic rams to level said gantry beam.

2. A gantry according to claim 1 wherein said universal joint means includes a ball and socket connection and wherein said releasable attachment means includes a hole in said sole plate, a portion on said ram extending through said hole, and means engaged with said portion to prevent withdrawal of said portion from said hole.

3. A gantry according to claim 1 or 2 wherein each sole plate includes upwardly projecting means to prevent said pair of beams from shifting off the sole plate.

4. A gantry according to claim 3 wherein said link support means of said load lifting link assembly comprises a pair of spaced apart plates, one for each associated spaced apart beam, and further comprises a member rigidly connected between said plates to which said link means is connected.

5. A gantry for straddling a load and for raising, supporting and lowering the same comprising:

a pair of spaced apart support assemblies, each support assembly comprising a stationary base portion and three vertically disposed independently extendable/retractable hydraulic rams mounted on said base portion in triangular relationship to one another;

a pair of tiltable sole plates, each tiltable sole plate being mounted on the upper ends of the three rams of a support assembly and including upwardly projecting beam engaging means;

means for connecting the upper end of each ram to its associated sole plate and including universal joint means and releasable attachment means, said universal joint means including a ball and socket connection and wherein said releasable attachment means includes a hole in a sole plate for receiving a ram end and means for engaging said ram end to prevent its withdrawal;

a load-supporting gantry beam extending between said spaced apart support assemblies and comprising a pair of beams arranged in spaced apart side-by-side relationship supported on said pair of sole plates between said upwardly projecting beam engaging means;

a load lifting link assembly mounted on said gantry beam and comprising link support means mounted on said pair of spaced apart beams, said link support means including a member spanning the space between said spaced apart beams, and link means connected to said member of said link support means and extending downwardly between said pair of spaced apart beams;

said spaced apart beams being maintained in spaced apart side-by-side relationship with each other by means of said sole plates and said lifting link assembly;

and selectively operable control means operatively connected to said hydraulic rams and operable to effect extension/retraction of all of said hydraulic rams in unison to raise and lower said gantry beam and to effect extension/retraction of individual or predetermined combinations of said hydraulic rams to level said gantry beam.

6. A gantry according to claim 1 or 2 or 5 wherein said control means comprises joy-stick type control levers, at least one lever for each support assembly.

* * * * *